US012313072B2

(12) United States Patent
Akei

(10) Patent No.: US 12,313,072 B2
(45) Date of Patent: May 27, 2025

(54) OIL-FREE PHASE SEPARATING COMPRESSOR

(71) Applicant: TRANE INTERNATIONAL INC., Davidson, NC (US)

(72) Inventor: Masao Akei, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 121 days.

(21) Appl. No.: 18/060,231

(22) Filed: Nov. 30, 2022

(65) Prior Publication Data

US 2024/0175437 A1 May 30, 2024

(51) Int. Cl.

| | |
|---|---|
| ***F04C 29/00*** | (2006.01) |
| ***F04C 18/02*** | (2006.01) |
| ***F04C 29/02*** | (2006.01) |
| ***F25B 1/04*** | (2006.01) |

(52) U.S. Cl.

CPC ..... *F04C 29/0092* (2013.01); *F04C 18/0215* (2013.01); *F04C 29/026* (2013.01); *F25B 1/04* (2013.01)

(58) Field of Classification Search

CPC ..... F04C 18/0215; F04C 29/026; F04C 29/0092; F25B 1/04

See application file for complete search history.

(56) References Cited

U.S. PATENT DOCUMENTS 4,615,184 A 10/1986 Kobayashi et al.
6,941,769 B1 9/2005 Hill et al.
7,862,312 B2 * 1/2011 Gopinathan ..... F04C 23/008 418/55.1
8,590,322 B2 11/2013 Kusada et al.
11,248,630 B2 2/2022 Alban et al.
2008/0107555 A1 * 5/2008 Lifson ..... F04C 29/128 418/91
2010/0077777 A1 * 4/2010 Lifson ..... F25B 9/06 62/513
2014/0044581 A1 * 2/2014 Mao ..... F04C 23/008 418/94
2014/0134030 A1 * 5/2014 Stover ..... F04C 18/0207 418/55.1
2015/0354572 A1 * 12/2015 Yokoyama ..... F04B 39/0246 418/55.6
2016/0040915 A1 * 2/2016 Jonsson ..... F04D 25/06 417/423.12
2019/0032665 A1 * 1/2019 Fukuhara ..... F04C 18/0215
2021/0348809 A1 11/2021 Bouquet

* cited by examiner

*Primary Examiner* — Connor J Tremarche
(74) *Attorney, Agent, or Firm* — HSML P.C.

(57) ABSTRACT

An oil-free compressor includes a compressor housing with a suction inlet and a discharge outlet, a compression mechanism and a liquid-vapor separation volume disposed within the compressor housing, a crankshaft. The compression mechanism has an inlet fluidly connected to the suction inlet and a discharge volume fluidly connected to the discharge outlet. The crankshaft is engaged with the compression mechanism. The liquid-vapor separation volume is configured to separate a mixed phase of working fluid into liquid working fluid and gaseous working fluid. The liquid working fluid is supplied to the bearing. A heating, ventilation, air conditioning, and refrigeration (HVACR) system includes a refrigerant circuit with an oil-free compressor, a condenser, one or more expanders, and an evaporator.

20 Claims, 4 Drawing Sheets

OIL-FREE PHASE SEPARATING COMPRESSOR

FIELD

This disclosure relates generally to a compressor. More specifically, this disclosure relates to directing of working fluid within a compressor in a refrigerant circuit in a heating, ventilation, air conditioning, and refrigeration (HVACR) system.

BACKGROUND

Compressors utilize a compression mechanism (e.g., intermeshing scroll members, intermeshed screws, impeller, or the like) to compress a fluid. Heating, ventilation, air conditioning, and refrigeration systems ("HVACR") may utilize compressors to compress a gaseous working fluid. Typically, a non-fixed member of the compression mechanism (e.g., an orbiting scroll, rotating screw, impeller, or the like) is moved (e.g., rotated, orbited, or the like) is rotated by a crankshaft. The compressor can include bearing(s) for supporting the crankshaft while it rotates.

BRIEF SUMMARY

In an embodiment, an oil-free compressor includes a compressor housing, a compression mechanism disposed within the compressor housing, a crankshaft engaged with the compression mechanism, a bearing for supporting the crankshaft, and a liquid-vapor separation volume disposed within the compressor housing. The compressor housing including a suction inlet and a discharge outlet. The compression mechanism has an inlet fluidly connected to the suction inlet and a discharge volume fluidly connected to the discharge outlet. Rotation of the crankshaft is configured to drive the compression mechanism to provide compression. The liquid-vapor separation volume configured to separate a mixed phase of working fluid into liquid working fluid and gaseous working fluid. The liquid working fluid is supplied to the bearing.

In an embodiment, an inner enclosure is disposed in the compressor housing. A motor is disposed in the inner enclosure and is configured to rotate the crankshaft. The crankshaft includes an interior gallery. The rotation of the crankshaft is configured to supply a portion of the liquid working fluid through the interior gallery and one or more liquid passages into the inner enclosure.

In an embodiment, the oil-free compressor is a scroll compressor, the compression mechanism being a pair of intermeshed scroll members, the crankshaft engaged with a non-fixed scroll member in the pair of intermeshed scroll members. The one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

In an embodiment, the compressor housing includes a separator inlet for the liquid-vapor separation volume and a separator outlet for the liquid-vapor separation volume. The compression mechanism forms compression pockets within the compressor housing, an intermediate injection port fluidly connects the liquid-vapor separation volume to at least one of the compression pockets.

In an embodiment, the liquid-vapor separation volume is configured to receive, via the separator inlet, the mixed phase of the working fluid, and to discharge the liquid working fluid from the compressor through the separator outlet.

In an embodiment, the intermediate injection port is configured to direct the gaseous working fluid into the at least one of the compression pockets.

In an embodiment, the compression mechanism is configured to compress the working fluid from an inlet pressure to a discharge pressure. The liquid-vapor separation volume is configured to receive the working fluid at an intermediate pressure that is between the inlet pressure and the discharge pressure.

In an embodiment, the suction inlet is fluidly connected to the liquid-vapor separation volume, a suction passageway fluidly connecting the liquid-vapor separation volume to the inlet of compression mechanism.

In an embodiment, the liquid-vapor separation volume is configured to receive, via the suction inlet, the mixed phase of the working fluid and to separate the gaseous working fluid from the liquid working fluid within the liquid-vapor separation. The suction passageway is configured to direct the gaseous working fluid to the inlet of the compression mechanism.

In an embodiment, a heating, ventilation, air conditioning, and refrigeration (HVACR) system includes a refrigerant circuit. The refrigerant circuit includes an oil-free compressor configured to compress a working fluid, a condenser configured to cool the working fluid compressed by the oil-free compressor, one or more expanders configured to expand the working fluid cooled by the condenser, and an evaporator configured to cool a second process fluid using the working fluid expanded by the one or more expanders. The oil-free compressor includes a compressor housing, a compression mechanism disposed within the compressor housing, a crankshaft engaged with the compression mechanism, a bearing for supporting the crankshaft, and a liquid-vapor separation volume disposed within the compressor housing. The compressor housing includes a suction inlet and a discharge outlet. The compression mechanism has an inlet fluidly connected to the suction inlet and a discharge volume fluidly connected to the discharge outlet. Rotation of the crankshaft is configured to drive the compression mechanism to compress the working fluid. The liquid-vapor separation volume configured to separate a mixed phase of the working fluid into liquid working fluid and a gaseous working fluid, the liquid working fluid is supplied to the bearing.

In an embodiment, the oil-free compressor includes an inner enclosure disposed in the compressor housing and a motor disposed in the inner enclosure. The motor is configured to rotate the crankshaft. The crankshaft includes an interior gallery. The rotation of the crankshaft is configured to supply a portion of the liquid working fluid through the interior gallery and one or more liquid passages into the inner enclosure.

In an embodiment, the oil-free compressor is a scroll compressor and the compression mechanism being a pair of intermeshed scroll members. The crankshaft is engaged with a non-fixed scroll member in the pair of intermeshed scroll members. The one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

In an embodiment, the compressor housing includes a separator inlet for the liquid-vapor separation volume and a separator outlet for the liquid-vapor separation volume. The one or more expanders include a first expander fluidly connecting the condenser to the separator inlet of the compressor and a second expander fluidly connecting the separator outlet of the compressor to the evaporator. The compression mechanism forms compression pockets within the compressor housing. The compressor includes an intermediate injection port that fluidly connects the liquid-vapor separation volume to at least one of the compression pockets.

In an embodiment, the separator inlet is configured to receive the mixed phase of the working fluid from the first expander. The second expander is configured to receive the liquid working fluid from the outlet of the separator outlet.

In an embodiment, the intermediate injection port is configured to direct the gaseous working fluid into the at least one of the compression pockets.

In an embodiment, the suction inlet is fluidly connected to the liquid-vapor separation volume. A suction passageway fluidly connects the liquid-vapor separation volume to the inlet of the compression mechanism.

In an embodiment, the liquid-vapor separation volume is configured to receive, via the suction inlet, the mixed phase of the working fluid and to separate the gaseous working fluid from the liquid working fluid within the liquid-vapor separation. The suction passageway is configured to direct the gaseous working fluid to the inlet of the compression mechanism.

In an embodiment, an oil-free scroll compressor includes a compressor housing, a pair of intermeshed scroll members disposed in the compressor housing, a crankshaft, a bearing for supporting the crankshaft, and a liquid-vapor separation volume disposed within the compressor housing. The compressor housing includes a suction inlet and a discharge outlet. The pair of intermeshed scroll members have an inlet fluidly connected to the suction inlet and a discharge volume fluidly connected to the discharge outlet. The crankshaft is engaged with a non-fixed scroll member in the pair of intermeshed scroll members. The liquid-vapor separation volume is configured to separate a mixed phase of the working fluid into liquid working fluid and gaseous working fluid, wherein the liquid working fluid is supplied to the bearing.

In an embodiment, the compressor also includes an inner enclosure disposed in the compressor housing and a motor is disposed in the inner enclosure. The crankshaft includes an interior gallery. The motor is configured to rotate the crankshaft, and the rotation of the crankshaft is configured to supply a portion of the liquid working fluid through the interior gallery and one or more liquid passages into the inner enclosure.

In an embodiment, the one or more liquid passages include a first liquid passage and a second liquid passage. The first liquid passage fluidly connects the interior gallery of the crankshaft to an alignment coupler for the pair of intermeshed scroll members. The second liquid passage fluidly connects the alignment coupler to the inner enclosure.

In an embodiment, the compressor housing includes a separator inlet for the liquid-vapor separation volume and a separator outlet for the liquid-vapor separation volume. The pair of intermeshed scroll members are intermeshed to form compression pockets within the compressor housing. An intermediate injection port fluidly connects the liquid-vapor separation volume to at least one of the compression pockets.

In an embodiment, the liquid-vapor separation volume is configured to receive, via the separator inlet, the mixed phase of the working fluid, and to discharge the liquid working fluid from the compressor through the separator outlet.

In an embodiment, the intermediate injection port is configured to direct the gaseous working fluid into the at least one of the compression pockets.

In an embodiment, the pair of intermeshed scroll members is configured to compress the working fluid from an inlet pressure to a discharge pressure. The liquid-vapor separation volume is configured to receive the working fluid at an intermediate pressure that is between the inlet pressure and the discharge pressure.

In an embodiment, the suction inlet is fluidly connected to the liquid-vapor separation volume, a suction passageway fluidly connecting the liquid-vapor separation volume to the inlet of the pair of scroll members.

In an embodiment, the liquid-vapor separation volume is configured to receive, via the suction inlet, the mixed phase of the working fluid and to separate the gaseous working fluid from the liquid working fluid within the liquid-vapor separation. The suction passageway is configured to direct the gaseous working fluid to the inlet of the pair of intermeshed scroll members.

In an embodiment, a heating, ventilation, air conditioning, and refrigeration (HVACR) system includes a refrigerant circuit. The refrigerant circuit includes an oil-free scroll compressor configured to compress a working fluid, a condenser configured to cool the working fluid compressed by the intermeshed scroll compressor, one or more expanders configured to expand the working fluid cooled by the condenser, and an evaporator configured to cool a second process fluid using the working fluid expanded by the one or more expanders. The oil-free scroll compressor includes a compressor housing, a pair of intermeshed scroll members disposed in the compressor housing, a crankshaft, a bearing for supporting the crankshaft, and a liquid-vapor separation volume disposed within the compressor housing. The compressor housing includes a suction inlet and a discharge outlet. The pair of intermeshed scroll members have an inlet fluidly connected to the suction inlet and a discharge volume fluidly connected to the discharge outlet. The crankshaft is engaged with a non-fixed scroll member in the pair of intermeshed scroll members. The liquid-vapor separation volume is configured to separate a mixed phase of the working fluid into liquid working fluid and gaseous working fluid, wherein the liquid working fluid is supplied to the bearing.

In an embodiment, the compressor includes an inner enclosure disposed in the compressor housing and a motor is disposed in the inner enclosure. The crankshaft includes an interior gallery. The motor is configured to rotate the crankshaft. The rotation of the crankshaft is configured to supply a portion of the liquid working fluid through the interior gallery and one or more liquid passages into the inner enclosure.

In an embodiment, the one or more liquid passages include a first liquid passage and a second liquid passage. The first liquid passage fluidly connects the interior gallery of the crankshaft to an alignment coupler for the pair of intermeshed scroll members. The second liquid passage that fluidly connects the alignment coupler to the inner enclosure.

In an embodiment, the compressor housing of the compressor includes a separator inlet for the liquid-vapor separation volume and a separator outlet for the liquid-vapor separation volume. The one or more expanders include a first expander and a second expander. The first expander fluidly connects the condenser to the separator inlet of the compressor. The second expander fluidly connects the separator outlet of the compressor to the evaporator. The pair of intermeshed scroll members are intermeshed to form compression pockets within the compressor housing. An intermediate injection port fluidly connecting the liquid-vapor separation volume to at least one of the compression pockets.

In an embodiment, the separator inlet is configured to receive the mixed phase of the working fluid from the first expander. The second expander is configured to receive the liquid working fluid from the outlet of the separator outlet.

In an embodiment, the intermediate injection port is configured to direct the gaseous working fluid into the at least one of the compression pockets.

In an embodiment, the suction inlet is fluidly connected to the liquid-vapor separation volume. A suction passageway fluidly connects the liquid-vapor separation volume to the inlet of the pair of intermeshed scroll members.

In an embodiment, the liquid-vapor separation volume is configured to receive, via the suction inlet, the mixed phase of the working fluid and to separate the gaseous working fluid from the liquid working fluid within the liquid-vapor separation. The suction passageway is configured to direct the gaseous working fluid to the inlet of the pair of intermeshed scroll members.

In an embodiment, the HVACR system also includes a level sensor for the liquid-vapor separation volume and a controller. The controller is configured to detect, using the level sensor, a liquid level of the liquid working fluid in the liquid-vapor separation volume is also configured to control the one or more expanders based on the liquid working fluid in the liquid-vapor separation volume.

In an embodiment, the one or more expanders includes a first expander. The controller is configured to adjust the first expander based on the liquid level in the liquid-vapor separation volume.

In an embodiment, the controller is configured to adjust a valve position of the first expander based on the liquid working level in the liquid-vapor separation volume to be above or below a predetermined level.

BRIEF DESCRIPTION OF THE DRAWINGS

Like reference numbers represent like parts throughout.

DETAILED DESCRIPTION

This disclosure relates generally to a scroll compressor. More specifically, this disclosure relates to directing of working fluid within a scroll compressor in a heating, ventilation, air conditioning, and refrigeration (HVACR) system.

Scroll compressors compress gas in compression pockets formed by the intermeshing scroll members. Scroll compressor generally include one or more mechanical components that require lubrication. In an oil-free compressor, oil is not available or used for lubricating such mechanical components. A scroll compressor can also include a motor that drives the movement of the non-fixed scroll member. During operation, the motor can generate heat which can buildup in the motor and reduce the operating speed of motor, decrease the efficiency of the motor, and/or damage the motor.

In some configurations, a refrigerant circuit can be configured to have an economizer. The economizer separates gaseous working fluid at an intermediate pressure from a mixed phase working fluid and supplies the intermediate pressure gaseous working fluid to the scroll compressor. The intermediate pressure gaseous working fluid is directed into compression pocket(s) of the intermeshed scroll members which may increase the efficiency and/or the capacity of the refrigerant circuit.

Embodiments of this disclosure are directed to oil-free scroll compressors having a liquid-vapor separation volume for separating liquid and gaseous working fluid therein and supplying the liquid working fluid to lubricate the mechanical component(s) of the scroll compressor. In some embodiments, a heating, ventilation, air conditioning, and refrigeration (HVACR) system includes a refrigerant circuit with an oil-free scroll compressor. In some embodiments, the compressor includes an inner enclosure for the motor, and a portion of the liquid working fluid is supplied to said enclosure to help cool the motor. In some embodiments, the liquid-vapor separation volume separates an intermediate pressure working fluid and the separated gaseous intermediate pressure working fluid is supplied to the compression pocket(s). In some embodiments, the liquid-vapor separation volume separates an inlet pressure working fluid and the separated inlet pressure gaseous working fluid flows is supplied to an inlet of the intermeshed scrolls.

Figure 1:
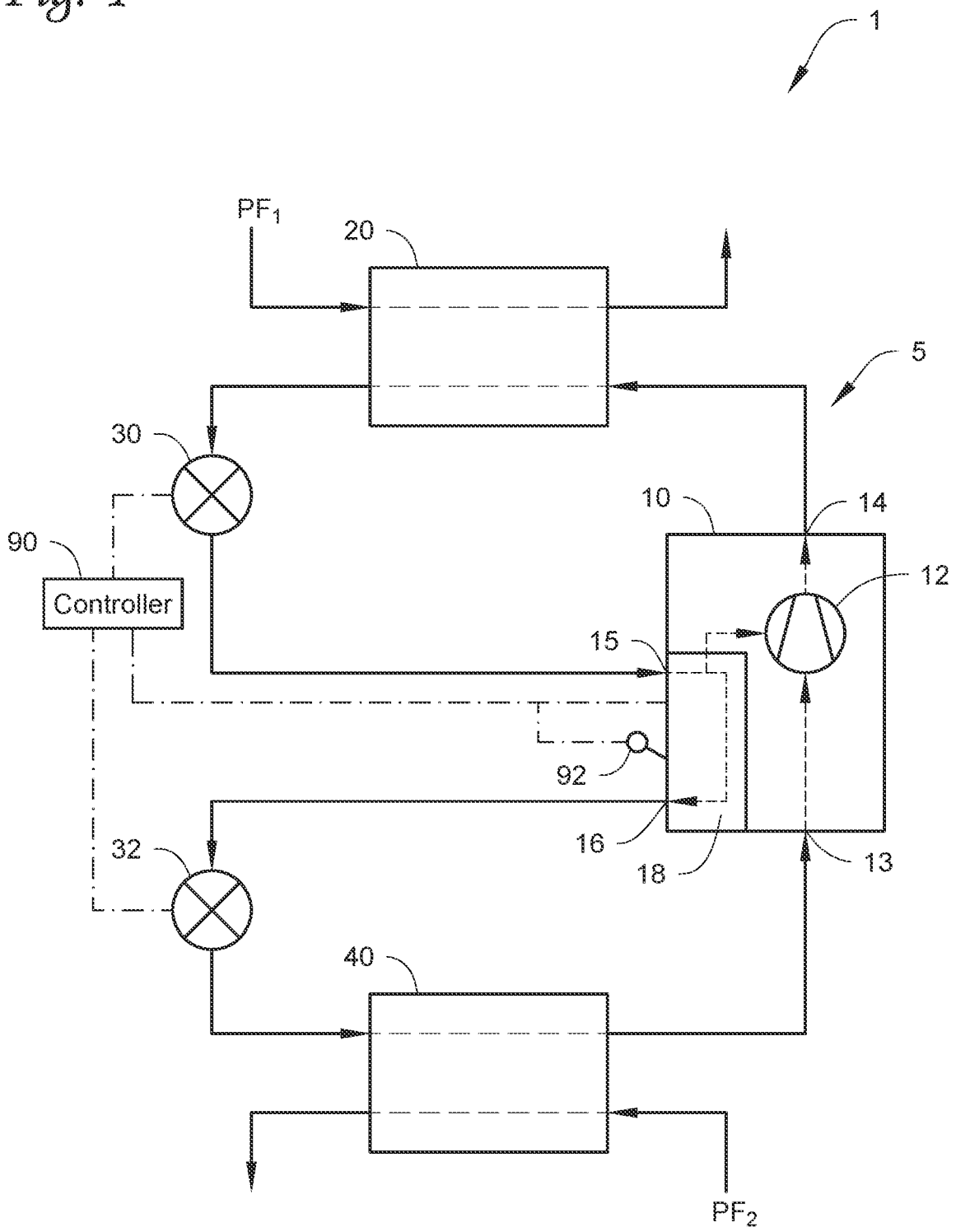
FIG. 1 is a schematic diagram of an embodiment of a refrigerant circuit of a HVACR system.

FIG. 1 is a schematic diagram of an embodiment of a refrigerant circuit 5 in a heating, ventilation, air conditioning, and refrigeration (HVACR) system 1. In an embodiment, the HVACR system 1 may be an industrial, commercial, or residential HVACR system 1 configured to condition the inside of a building (e.g., office space, residential house, or the like). In an embodiment, the HVACR system 1 may be a transport HVACR use for cooling the inside of a transport unit (e.g., shipping container, transport/trucking container, reefer, or the like) and/or a passenger vehicle (e.g., a bus, a plane, or the like).

The refrigerant circuit 5 includes a compressor 10, a condenser 20, a first expansion device 30, a second expansion device 32, and an evaporator 40. In an embodiment, the refrigerant circuit 5 can be modified to include additional components. For example, the refrigerant circuit 5 in an embodiment can include one or more flow control devices, a receiver tank, a dryer, a suction-liquid heat exchanger, or the like. The components of the refrigerant circuit 5 are fluidly connected. Dotted lines are provided in FIGS. 1 and 3 to indicate fluid flows through some components (e.g., compressor 10, condenser 20, evaporator 40) for clarity, and should be understood as not specifying a specific route within each component.

The refrigerant circuit 5 can be configured as a cooling system (e.g., a fluid chiller of an HVACR, an air conditioning system, or the like) that can be operated in a cooling mode, and/or the refrigerant circuit 5 can be configured to operate as a heat pump system that can run in a cooling mode and a heating mode.

The refrigerant circuit 5 applies known principles of gas compression and heat transfer. The refrigerant circuit 5 can be configured to heat or cool a process fluid (e.g., water, air, chiller fluid, or the like). In an embodiment, the refrigerant circuit 5 may represent a chiller that cools a process fluid such as water or the like. In an embodiment, the refrigerant circuit 5 may represent an air conditioner and/or a heat pump that cools and/or heats a process fluid such as air, water, or the like.

During the operation of the refrigerant circuit 5, a working fluid (e.g., containing refrigerant, a refrigerant mixture, or the like) flows into the compressor 10 from the evaporator in a gaseous state at a relatively lower pressure. The working fluid is oil-free (i.e., does not contain any oil). For example, the refrigerant(s) in the working fluid are used as the lubricant for mechanical components of the refrigerant circuit 5. Accordingly, the refrigerant circuit 5 and the components disposed therein (e.g., the compressor 10, expansion devices 30, 32, the evaporator 40, and the like) are oil-free.

The compressor 10 compresses the gas into a high pressure state, which also heats the gas. The compressor 10 includes a suction inlet 13, a discharge outlet 14, and a compression mechanism 12 configured to move within the compressor 10 to compress the gas into the high pressure state. The working fluid flows from the evaporator 40 into the suction inlet 13 of the compressor 10 and is discharged from the discharge outlet 14 of the compressor 10 after being compressed by the compression mechanism 12. The working fluid flows from the suction inlet 13 into the compression mechanism 12 and then from the compression mechanism 12 to and out of the compressor 10 through the discharge outlet 14.

The compressor 10 may be, but not limited to, a scroll compressor, a screw compressor, a centrifugal compressor, or the like. In an embodiment, the compressor 10 is a type that utilizes injection of intermediate pressure fluid into the compression mechanism 12 (e.g., economizer injection or the like). In an embodiment, the compressor 10 is a scroll compressor and the compression mechanism 12 is a pair of intermeshed scroll members (e.g., intermediate pressure gaseous working fluid is injected into a formed intermediate compression pocket between the intermeshed scroll members). In an embodiment, the compressor 10 is screw compressor and the compression mechanism 12 is a pair of intermeshed screws (e.g., intermediate pressure gaseous working fluid is injected into a formed intermediate compression pocket between the intermeshed screws). In an embodiment, the compressor 10 is a centrifugal compressor and the compression mechanism 12 is a pair of impellers (e.g., intermediate pressure gaseous working fluid is injected into the fluid flowing from the first impeller to the second impeller within the compressor 10).

After being compressed, the relatively higher pressure and higher temperature gas flows from the discharge outlet 14 of the compressor 10 to the condenser 20. The working fluid flows through the condenser 20. In addition to the working fluid flowing through the condenser 20, a first process fluid $PF_1$ (e.g., external air, external water, cooling/heater water, glycol, combinations thereof, or the like) also separately flows through the condenser 20. The first process fluid $PF_1$ absorbs heat from the working fluid as the first process fluid $PF_1$ flows through the condenser 20, which cools the working fluid as the working fluid flows through the condenser 20. The working fluid condenses to liquid and then flows into the first expansion device 30.

The first expansion device 30 allows the working fluid to expand, which converts the working fluid to a mixed vapor and liquid state. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expansion device used in the field for expanding a working fluid to cause the gaseous working fluid to decrease in pressure and temperature. The first expander 30 and the second expander 32 may be the same type of expansion device or may be different types of expansion devices. In an embodiment, one or both of the expanders 30, 32 are an adjustable type of expansion device. For example, the expanders 30, 32 may each be an expansion valve.

The relatively lower temperature, intermediate pressure, vapor/liquid working fluid then flows into an intermediate pressure inlet 15 of the compressor 10. The compressor 10 includes a liquid-vapor separation volume 18 configured to allow separation of liquid and vapor phases within. The intermediate pressure working fluid flows through the intermediate pressure inlet 15 into the liquid-vapor separation volume 18 of the compressor 10. The intermediate pressure inlet of the compressor 10 can also be referred to as a separator inlet or an intermediate pressure fluid inlet of the compressor 10. The vapor and liquid portions of the intermediate pressure working fluid separate within the liquid-vapor separation volume 18 of the compressor 10. In an embodiment, the intermediate pressure refrigerant may be allowed to expand within the liquid-vapor separation volume 18 causing some of the liquid working fluid in the liquid-vapor separation volume 18 to become vapor. The vapor intermediate pressure fluid in the liquid-vapor separation volume 18 is directed into the compression mechanism 12. The liquid working fluid is used to lubricate and/or cool components of the compressor 10 (e.g., bearings, motor, or the like). The relatively lower temperature, intermediate pressure, liquid working fluid is discharged from the liquid-vapor separation volume 18 through an intermediate pressure outlet 16 of the compressor 10. The intermediate pressure outlet 16 of the compressor 10 can also be referred to as a separator outlet or an intermediate pressure liquid discharge outlet of the compressor 10.

The relatively lower temperature, liquid working fluid flows from the liquid-vapor separation volume 18 of the compressor 10 to the second expansion device 32. The second expansion device 32 allows the working fluid to expand, which converts the working fluid to a mixed vapor and liquid state. The expansion also causing further cooling the working fluid.

The further relatively lower temperature, vapor/liquid working fluid then flows from the second expander 32 into the evaporator 40. A second process fluid $PF_2$ (e.g., air, chiller liquid, water, glycol, combinations thereof, or the like) also flows through the evaporator 40. The working fluid absorbs heat from the second process fluid $PF_2$ as it flows through the evaporator 40, which cools the second process fluid $PF_2$ as it flows through the evaporator 40. As the working fluid absorbs heat, the working fluid evaporates to vapor. The working fluid then returns to the compressor 10 from the evaporator 40. The main flow path of the refrigerant circuit 5 (for the working fluid) extends from the compression mechanism 12 of the compressor 10 through the condenser 20, the first expander 30, the separation volume 18 of the compressor 10, the second expander 32, and the evaporator 40 and back to the compression mechanism 12. The above-described process continues while the refrigerant circuit 5 is operated, for example, in a cooling mode.

The HVACR system 1 can also include a controller 90. In an embodiment, the controller 90 may be the controller of the HVACR system 1. In an embodiment, the controller 90 may be the controller of the refrigerant circuit 5. For example, the controller 90 may be the controller of the compressor 10. Dashed dotted lines are provided in FIGS. 1 and 3 to illustrate electronic communications between different features. For example, a dashed dotted line extends from the controller 90 to the compressor 10 as the controller 90 is able to control compressor 10 (e.g., control a speed of the compressor). For example, a dashed dotted line extends from the controller 90 to a liquid level sensor 92 for the liquid-vapor separation volume 18 of the compressor 10 as the controller 90 is configured to use the level sensor 92 to detect a liquid level of the liquid working fluid in the liquid-vapor separation volume 18 (e.g., detect whether the level is above a predetermined first/minimum liquid level, detect whether the liquid level is above a predetermined different/second/maximum liquid level). For example, a dashed-dotted line extends from the controller 90 to the first expander 30 as the controller 90 controls the first expander 30. For example, a dashed-dotted line extends from the controller 90 to the second expander 32 as the controller 90 controls the second expander 32.

The controller 90 may be configured to control the liquid level of the liquid working fluid in the liquid-vapor separation volume 18 of the compressor 10. For example, the controller 90 may adjust the first expander 30 (e.g., adjust the valve position of the first expander 30) and/or adjust the second expander 32 (e.g., adjust the valve position of the second expander 32) to control the level of the liquid working fluid in the liquid-vapor separation volume 18 of the compressor 10. In an embodiment, the controller 90 may be configured to control the liquid level to be above a first predetermined level (e.g., a predetermined minimum level) and/or below a second predetermined level (e.g., a predetermined maximum level). For example, the controller 90 can control the liquid level to be in a predetermined range (e.g., to be above the first predetermined level and below the second predetermined level). For example, the predetermined first level can be based on maintaining the liquid level above the opening for the intermediate pressure outlet 16 (e.g., ensures no gaseous working fluid flows into the intermediate pressure outlet 16). For example, the predetermined second level can be based on preventing flooding of the compressor 10 and/or preventing the liquid from flowing into the compression mechanism 12.

In an embodiment, the controller 90 includes memory (not shown) for storing information and a processor (not shown). The controller 90 in FIG. 1 and described below is described/shown as a single component. However, it should be appreciated that a "controller" as shown in the Figures and described herein may include multiple discrete or interconnected components that include a memory (not shown) and a processor (not shown) in an embodiment.

Figure 2:
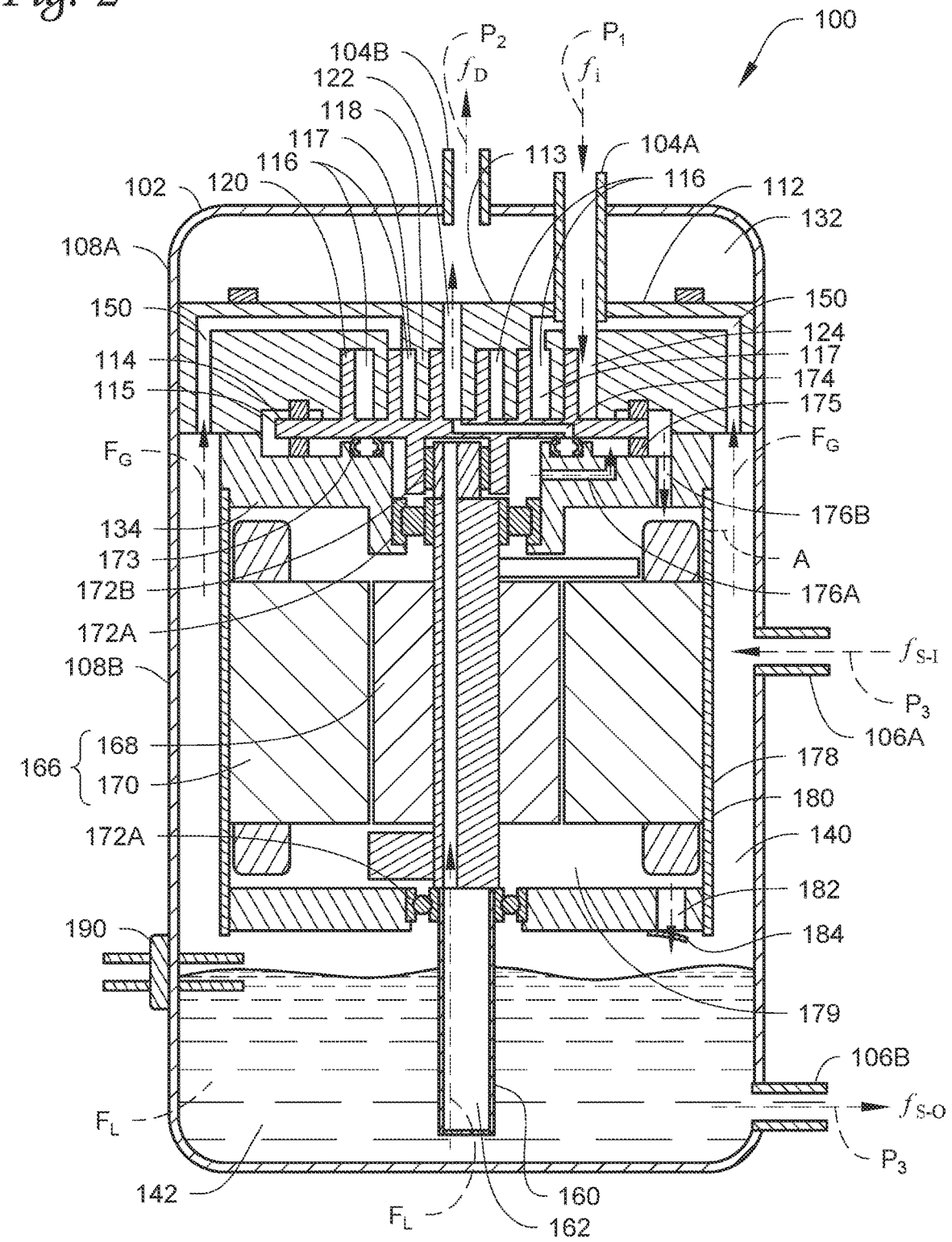
FIG. 2 is a schematic diagram of a cross section of an embodiment of a compressor.

FIG. 2 is a schematic cross-sectional view of a scroll compressor 100. In an embodiment, the scroll compressor 100 may be the compressor 10 in the refrigerant circuit 5 in FIG. 1. FIG. 2 is a vertical cross section of the compressor 100. The compressor 100 includes a compressor housing 102 that contain components of the compressor 100. The compressor housing 102 is shown as a single piece in FIG. 2. In an embodiment, the compressor housing 102 may be formed of a plurality of segments that are affixed together. As shown in FIG. 2, the compressor housing 102 is the outer housing of the compressor 100.

The illustrated compressor 100 is a single-stage scroll compressor. More specifically, the illustrated compressor 100 is a single-stage vertical scroll compressor. It is to be appreciated that the principles described herein are not intended to be limited to single-stage scroll compressors and that they can be applied to multi-stage scroll compressors having two or more compression stages. Generally, the embodiments as disclosed herein are suitable for a compressor with a vertical or a near vertical crankshaft (e.g., as shown in FIG. 2). In other embodiments, the concepts described herein for the compressor 100 may be adapted to be applied to a compressor with a non-vertical or a horizontal crankshaft. It would be appreciated that concepts described for the compressor 100 may be applied to other types of compressors (e.g., screw compressor centrifugal compressor, or the like) that utilizes a different type of compression mechanism.

The scroll compressor 100 includes a fixed scroll member 112 and a non-fixed scroll member 114. Applying known aspects of scroll compressor compression, the scroll compressor 100 utilizes the two intermeshing scroll members 112, 114 to form a plurality of compression pockets 116, 117 in which gas is trapped and then compressed. The fixed scroll 112 has a baseplate 113 and a spiral wrap 118 that projects in a direction towards the non-fixed scroll member 114. The non-fixed scroll member 114 has a baseplate 115 and a spiral wrap 120 that projects in a direction towards the fixed scroll member 112. The spiral wrap 118 of the fixed scroll 112 is intermeshed with the spiral wrap 120 of the non-fixed scroll member 114 forming the compression pockets 116, 117 there between. In an embodiment, the axial end of one or both of the spiral wraps 118, 120 may include a tip seal (not shown) to help encourage scaling between each spiral wraps 118, 120 and the opposing baseplate 113, 115.

The fixed scroll member 112 is a scroll member that is in a fixed position within the compressor housing 102 and is not configured to be rotated or moved (e.g., orbited) during the operation of the scroll compressor 100. The fixed scroll member 112 may be referred to as a fixed scroll, a non-orbiting scroll, a stationary scroll, the first scroll member, or the like. In an embodiment, the fixed scroll 112 can be directly attached to the compressor housing 102 of the scroll compressor 100.

The non-fixed scroll member 114 is a scroll member that engages with an end of a crankshaft 126. During operation of the scroll compressor 100, the non-fixed scroll member 114 is orbited relative to the fixed scroll member 112. The non-fixed scroll member 114 is configured to be moved relative to the compressor housing 102 during operation of the compressor 100. The non-fixed scroll member 114 may also be referred to as an orbiting scroll, a moving scroll, the second scroll member, or the like.

The compressor housing 102 contains an internal volume that includes an upper volume 132 and a lower volume 140 of the compressor 100. The compressor housing 102 of the scroll compressor 100 can have an upper portion 108A and a lower portion 108B. In an embodiment, the volume within the upper portion 108A may be defined as the upper volume 132 of the scroll compressor 100 and the volume contained within the lower portion 108B may be defined as the lower volume 140 of the scroll compressor 100. As shown in the illustrated embodiment, the upper volume 132 and the lower volume 140 are fluidly separated by the fixed scroll 112.

As shown in FIG. 2, the intermeshed spiral wraps 118, 120 have discharge volume 122. In a scroll compressor 100, the discharge volume 122 is a volume where the intermeshed spiral wraps 118, 120 end and the compressed gas exits the intermeshed scrolls 112, 114. The discharge volume 122 is fluidly connected to the upper volume 132 of the scroll compressor 100. The compressor 100 may include a valve (e.g., a check valve) (not shown) to regulate the flow of pressurized gas from the discharge volume 122. The intermeshed scrolls 112, 114 also have an inlet 124 through which gas flows into the intermeshed scrolls 112, 114. The inlet 124 is formed by/at an outer radius of the spiral wraps 118, 120 (e.g., at the outermost spiral of each spiral wrap 118, 120, at the start of the compression process, not at an intermediate location/compression pocket 117, or the like). For example, the inlet 124 is at a location at which the compression pockets 116 are initially being formed.

The compressor 100 includes a bearing support 134. The bearing support 134 is affixed to the baseplate 113 of the fixed scroll 112. In the illustrated embodiment, the bearing support 134 is affixed to the fixed scroll 112 by a plurality of bolts. In an embodiment, the bearing support 134 may be, additionally or alternatively, affixed to the compressor housing 102. The non-fixed scroll 114 is disposed between the fixed scroll 112 and the bearing support 134. The bearing support 134 is disposed in the lower volume 140 of the compressor 100.

The compressor 100 includes a plurality of fluid ports that extend through the housing 102 for supplying fluid into and discharge fluid from the compressor 100. Working fluid enters and exits the compressor 100 by flowing through the fluid ports in the housing 102. The fluid ports include a suction inlet 104A, a discharge outlet 104B, a separator inlet 106A, and a separator outlet 106B. An inlet flow $f_i$ of the working fluid to be compressed flows into the compressor 100 though the suction inlet 104A in the housing 102 at a relatively lower pressure (e.g., at a first pressure $P_1$). The inlet flow $f_i$ of the working fluid flows from the suction inlet 104A into the inlet 124 of the intermeshed scrolls 112, 114. The working fluid is compressed by the intermeshed scrolls 112, 114 as the working fluid travels between the intermeshed scrolls 112, 114. The compressed working fluid flows out of the scroll compressor 100 by flowing from the discharge volume 122 to and through the discharge outlet 104B. In the illustrated embodiment, the compressed working fluid flows from the discharge volume 122 into the upper volume 132, and then from the upper volume 132 into the discharge outlet 140B. A discharge flow $f_D$ of the working fluid is discharged from the discharge outlet 104B of the compressor 100 at a relatively higher pressure (e.g., at a second pressure $P_2$ greater than the first pressure $P_1$).

A flow $f_{S-I}$ of the working fluid at an intermediate pressure (e.g., at a third pressure $P_3$ greater than the first pressure $P_1$ and less than the second pressure $P_2$) is supplied to the compressor 100. For example, the intermediate pressure working fluid is supplied from a first expander in the refrigerant circuit of the compressor 100 (e.g., from the first expander 30 in FIG. 1) to the separator inlet 106A of the compressor 100. The intermediate pressure working fluid in flow $f_{S-I}$ is the compressed working fluid in the discharge flow $f_D$ after being cooled in a condenser in the refrigerant circuit of the compressor 100 (e.g., condenser 20) and then expanded by the first expander in the refrigerant circuit of the compressor 100.

The intermediate pressure working fluid in flow $f_{S-I}$ flows through into the lower volume 140 of the compressor 100. The working fluid in the flow $f_{S-I}$ is a mixture of liquid working fluid and gaseous working fluid. In an embodiment, the lower volume 140 may allow for expansion of the incoming intermediate pressure working fluid, causing a portion of the incoming intermediate working fluid flow $f_{S-I}$ to also convert into gaseous working fluid within the lower volume 140. In some embodiments, there may be little to no pressure drop caused to the incoming intermediate pressure working fluid when flowing into the lower volume 140. The lower volume 140 is configured to allow separation of the liquid portion $F_L$ and gaseous portion $F_G$ of the intermediate pressure working fluid. In the illustrated embodiment, the lower volume 140 is the liquid-vapor separation volume of the compressor 100.

The liquid intermediate pressure working fluid $F_L$ accumulates within the lower volume 140. In particular, the liquid intermediate pressure working fluid $F_L$ accumulates in a bottom 142 of the lower volume 140. The separator outlet 106B extends from the lower volume 140 of the compressor 100. The liquid intermediate pressure working fluid $F_L$ is discharged from the lower volume 140 of the compressor 100 through the separator outlet 106B. A flow $f_{S-O}$ of the liquid intermediate pressure working fluid $F_L$ flows from the separator outlet 106B of the compressor 100. For example, the liquid intermediate pressure working fluid $F_L$ is supplied to a second expander in the refrigerant circuit of the compressor 100 (e.g., to the second expansion 32 in the refrigerant circuit 5 in FIG. 1).

The compressor 100 includes one or more intermediate injection ports 150 formed in the fixed scroll 112 for injecting intermediate pressure working fluid into the intermeshed scrolls 112, 114. The intermediate injection port(s) 150 fluidly connect the lower volume 140 to one or more the intermediate compression pockets 117 of the intermeshed scrolls 112, 114. The intermediate injection port(s) 150 are configured to inject/direct the intermediate pressure gaseous working fluid $F_G$ into the intermeshed scrolls 112, 114. An intermediate compression pocket 117 is one of the compression pockets 116, 117 that is partially through the compression process (e.g., at a pressure between the inlet pressure $P_1$ and the discharge pressure $P_2$, has travelled part way and is disposed at an intermediate position between the inlet 124 and the discharge volume 122). The gaseous intermediate pressure working fluid $F_G$ is added to the working fluid already within the intermediate compression pocket 117, which is then further compressed (e.g., to the discharge pressure $P_2$).

The specific location(s) of the intermediate inlet port(s) 150 with respect to the compression process can be varied. In an embodiment, a location of an intermediate injection port 150 can be located so that the pressure of the intermediate compression pocket 117 is relatively near the suction pressure (e.g., at a location in which compression is just beginning). In the illustrated embodiment, this is a location at a relatively outer extent of the intermeshed scrolls 112, 114 (e.g., relatively closer to the inlet 124, closer to the inlet 124 than the discharge volume 122). In such an embodiment, supplying the intermediate pressure gaseous working fluid $F_G$ at this location/pressure can increase a capacity of the HVACR system of the compressor 100, but may also increase energy required, which may reduce an efficiency of the HVACR system of the compressor 100. In an embodiment, a location of the intermediate injection port 150 can be selected so that the pressure in the intermediate compression pocket 117 is relatively near the discharge pressure (e.g., at a location near the discharge). In the illustrated embodiment, this is a location at a relatively inner extent of the intermeshed scrolls 112, 114 (e.g., relatively closer to the discharge volume 122, closer to the discharge volume 122 than the inlet 124). In such an embodiment, supplying the intermediate pressure gaseous working fluid $F_G$ to the compression process at this location/pressure can increase the efficiency of the HVACR system, but may only slightly improve the capacity of the HVACR system.

The selection of the location(s) of the intermediate inlet port(s) 150 can accordingly be balanced between increasing capacity and maintaining efficiency. Such location(s) may be selected based on, for example, modeling the anticipated efficiency and capacity changes, testing to determine the optimal location, or combinations thereof.

As explained above, the non-fixed scroll 114 is moved (e.g. orbited) by the crankshaft 160. The crankshaft 160 can be rotated by, for example, an electric motor 166. The electric motor 166 includes a rotor 168 and a stator 170. The rotor 168 and the crankshaft 160 are affixed together such that they rotate together. For example, the rotor 168 and the crankshaft 160 can be affixed together using an interference fit or other type of fit. The electric motor 166 may operate using known principles to rotate the crankshaft 160. In an embodiment, the crankshaft 160 may be rotated by other mechanisms other than the electric motor 166, such as, for example, an external electric motor, an external combustion engine, or other such mechanisms. Accordingly, such embodiments may not include the electric motor 166 as shown in FIG. 2.

In an embodiment, the scroll compressor 100 includes bearings 172A, 172B along the crankshaft 160. Radial bearing(s) 172A can support the crankshaft 160 while still allowing the crankshaft 160 to rotate. The radial bearing(s) 172A are configured to support the crankshaft 160 in the radial direction while allowing the crankshaft 160 to rotate. One or more of the radial bearing(s) 172A can also be configured to support the weight of the crankshaft 160 (and the rotor 168). For example, a radial bearing 172A may be a deep groove ball bearing that is configured to support the crankshaft 160 in the radial direction and to also support the weight of the crankshaft 160 in the axial direction while it rotates. In an embodiment, the scroll compressor 100 may include one or more bearings 172A to support the crankshaft 160. As shown in the illustrated embodiment, an end of the crankshaft 160 that engages the non-fixed scroll 114 is an eccentric end relative to the rest of the crankshaft 160 (e.g., as the axis of said end is radially offset from the rotational axis of the crankshaft 160). The compressor 100 can include a radial bearing 172B for the eccentric end of the crankshaft 160. The radial bearing 172B is configured to prevent the crankshaft 160 from transferring its rotation to the non-fixed scroll 114. The radial movement of eccentric end (e.g., the movement of the eccentric end that is perpendicular to the axis of rotation) is still transferred to the non-fixed scroll 114 causing the non-fixed scroll 114 to orbit instead of rotate.

The compressor 100 can include a thrust bearing 173 for supporting the non-fixed scroll 114. The thrust bearing 173 supports the non-fixed scroll 114 in an axial direction (e.g., a vertical direction, vertically upward in FIG. 2). The thrust bearing 173 is formed by a rear surface of the baseplate 115 of the non-fixed scroll 114 and a surface of the bearing support 134. As shown in FIG. 2, the thrust bearing 173 can be a gas thrust bearing (e.g., an aerostatic gas bearing). The compressor 100 includes a gas supply passage 174 that supplies a flow of the compressed working fluid to the thrust bearing 173. As shown in FIG. 2, the non-fixed scroll 114 may include the gas supply passage 174 that fluidly connects the discharge volume 122 of the intermeshed scrolls 112, 114 to the thrust bearing 173. In another embodiment, the gas supply passage 174 may be configured to supply compressed gas from one of the compression pockets 116, 117 instead of the discharge volume 122.

As shown in the illustrated embodiment, the scroll compressor 100 can include an alignment coupler for maintaining alignment of the intermeshed scrolls 112, 144, such as an Oldham coupling 175. In an embodiment, the alignment coupler (e.g. the Oldham coupling 175 or the like) and the radial bearing 172B can be utilized so that the radial movement of the eccentric end (relative to the crankshaft 160) is transferred to the orbiting scroll 114 without transferring the rotational movement. Accordingly, the non-fixed scroll 114 orbits relative to the fixed scroll 112 without rotating in an embodiment.

In the illustrated embodiment, liquid intermediate pressure refrigerant $F_L$ is provided to the bearings 172A, 172B along the crankshaft 160. The crankshaft 160 includes an interior gallery 162. The centrifugal force of the rotating crankshaft 160 suctions liquid working fluid $F_L$ in the lower volume 140 (e.g., in the bottom 142 of the lower volume 140) into the gallery 162 and to flow through the interior gallery 162 (e.g., to flow upwards in the interior gallery 162). This liquid working fluid $F_L$ is supplied from the interior gallery 162 to the bearings 172A, 172B. In an embodiment, the compressor 100 may include a pump (not shown) configured to pump a portion of liquid working fluid $F_L$ from the lower volume (e.g., from the bottom 142 of the lower volume 140) into and through the interior gallery 162 of the crankshaft 160.

The compressor 100 can also include one or more liquid supply passages 176A, 176B for directing a portion of the liquid working fluid $F_L$ suctioned through the interior gallery 162 to the alignment coupler (e.g., Oldham coupling 175) and/or to the motor 166. The interior gallery 162 and the liquid supply passage(s) 176A, 176B configured to supply liquid working fluid $F_L$ to the alignment coupler and/or the motor 166. As shown in FIG. 2, a (first) liquid supply passage 176A can supply liquid working fluid $F_L$ from the interior gallery 162 to the alignment coupler. In the illustrated embodiment, liquid working fluid $F_L$ flows from the interior gallery 162 through the bearing 172B to the liquid supply passage 176A. In the illustrated embodiment, the liquid supply passage 176A is formed in the bearing support 134. In an embodiment, the liquid supply passage 176A may be provided in the baseplate 115 of the non-fixed scroll 114 (e.g., extending from at or about the center of the baseplate 115 to the outer radius of the baseplate 115).

As shown in FIG. 2, a (second) liquid supply passage 176B can supply liquid working fluid $F_L$ from the interior gallery 162 to the motor 166. For example, liquid working fluid $F_L$ flows from the interior gallery 162 through the bearing 172B and the liquid supply passage 176A to the alignment coupler, and the liquid supply passage 176B supplies the liquid working fluid $F_L$ from the alignment coupler to the motor 166. The liquid working fluid $F_L$ is supplied onto the motor 166. In particular, the liquid supply passage 176B can be configured to direct liquid working fluid $F_L$ supplied onto the stator 170 of the motor 166. The liquid working fluid $F_L$ provides cooling to the motor 166 as it flows over the motor 166.

As shown in FIG. 2, the compressor 100 can include an inner enclosure 178 for the motor 166. The inner enclosure 178 is disposed in the lower volume 140 of the compressor 100. The inner enclosure 178 includes a side partition 180. For example, the side partition 180 encircles the motor 166. The inner enclosure 178 defines an enclosed inner space 179 within the lower volume 140, and the motor 166 disposed within said enclosed inner space 179. As shown in FIG. 2, the upper wall of the inner enclosure 178 may be formed by the bearing support 134.

The (second) liquid supply passage 176B supplies liquid working fluid $F_L$ from the interior gallery 162 into the inner enclosure 178. The liquid working fluid $F_L$ then flows across the motor 162 (e.g., over and along the outside surfaces of the motor 162, through the motor 162). The liquid working fluid $F_L$ can cool the motor 162 as it flows across the motor 162. After passing across the motor 162, the liquid working fluid $F_L$ flows into the bottom of the inner enclosure 178 (e.g., a bottom/lower portion of the inner enclosure 178 disposed below the motor 162). The liquid working fluid $F_L$ then flows from the bottom of the inner enclosure 178 back into the bottom 142 of the lower volume 140. The inner enclosure 178 may include a drain 182 at the bottom of the inner enclosure 178 (e.g., disposed in the lower end of the inner enclosure 178). The liquid working fluid $F_L$ may flow from the bottom of the inner enclosure 178 through the drain 182 and/or through a (lower) bearing 172A for the crankshaft 160.

In an embodiment, the compressor 100 may include a valve 184 for the drain 182. The valve 184 is configured to control the amount of working fluid that passes through the drain 182. For example, the valve 184 can ensure liquid working fluid flows through the lower bearing 172A by helping to maintain a minimum amount of liquid remains in the bottom of the inner enclosure 178. In another embodiment, the drain 182 may be configured (e.g., located, sized, or the like) to control an amount of liquid working that passes through the drain 182.

As described above, the liquid working fluid $F_L$ flows out of the gallery 162 in the crankshaft 160 and then flows to and through each of the bearings 172A, 172B. In another embodiment, the crankshaft 160 may include one or more holes (not shown) that extends from the gallery 162 to the outer radial surface of the crankshaft 160 (e.g., horizontal passageways/holes in the view shown in FIG. 2). The hole(s) can be located at one or more of the bearings 172A, 172B. The liquid working fluid $F_L$ may be provided directly to each bearing 172A, 172B from the gallery 162 through a respective one of the holes.

In embodiment, the radial bearings 172A, 172B may be, for example, rolling bearings or the like. A rolling bearing may be, for example, a ball bearing, roller bearing, or the like. In an embodiment, a radial bearing 172A, 172B may be a ceramic bearing (e.g., ceramic rolling bearing). For example, the ceramic type bearings may advantageously maintain their performance while being lubricated with liquid working fluid.

In FIG. 2, the right intermediate inlet port 150 is shown as being located directly above the separator inlet 106A. In an embodiment, each of the intermediate inlet port(s) 150 are radially offset from the separator inlet 106A (e.g., radially offset by at least 30 degrees, radially offset by at or about 90 degrees from the separator inlet 106A). Radial offset can be measured as the radius between the locations at which the separator inlet 106A and the intermediate inlet port 150 connect to the lower volume 140. For example, this radial offset can help prevent entrainment of liquid in the intermediate pressure gaseous working fluid $F_G$ flowing into the intermediate inlet port(s) 150. In an embodiment, the lower volume 140 may contain features (e.g., baffle(s), screen(s), torturous path(s), and the like) for ensuring liquid-vapor separation and preventing entrainment of liquid in the intermediate pressure gaseous working fluid $F_G$ flowing into the intermediate inlet port(s) 150.

In an embodiment, the suction inlet 106A may connect to the inner enclosure 178 in the lower volume 140. The suction inlet 106A directs the flow of intermediate working fluid flow $f_{S-I}$ into the inner enclosure 178. The intermediate working fluid then flows out of the inner enclosure 178 (e.g., through drain 182, through the bearing 172A, through other openings in the inner enclosure 178, and the like). For example, the suction inlet 106A may extend to and through the side partition 180 of the inner enclosure 178 (e.g., above the motor 166 at location A). This configuration can also advantageously help cool the motor 166 and/or prevent entrainment of liquid in the intermediate pressure gaseous working fluid $F_G$ flowing into the intermediate inlet port(s) 150.

The compressor 100 includes a level sensor 190 configured to detect a liquid level of the liquid working fluid $F_L$ in the lower volume 140 of the compressor 100 (e.g., in the bottom 142 of the lower volume 140). A controller of the HVACR system of the compressor 100 (e.g., controller 90 in FIG. 1) may be configured to detect the level of the liquid working fluid $F_L$ in the lower volume 140 of the compressor 100 using the level sensor 190. In an embodiment, the controller may be configured control the liquid level of the liquid working fluid $F_L$ in the lower volume 140 of the compressor 100 as discussed for the compressor 10 in FIG. 1.

Figure 3:
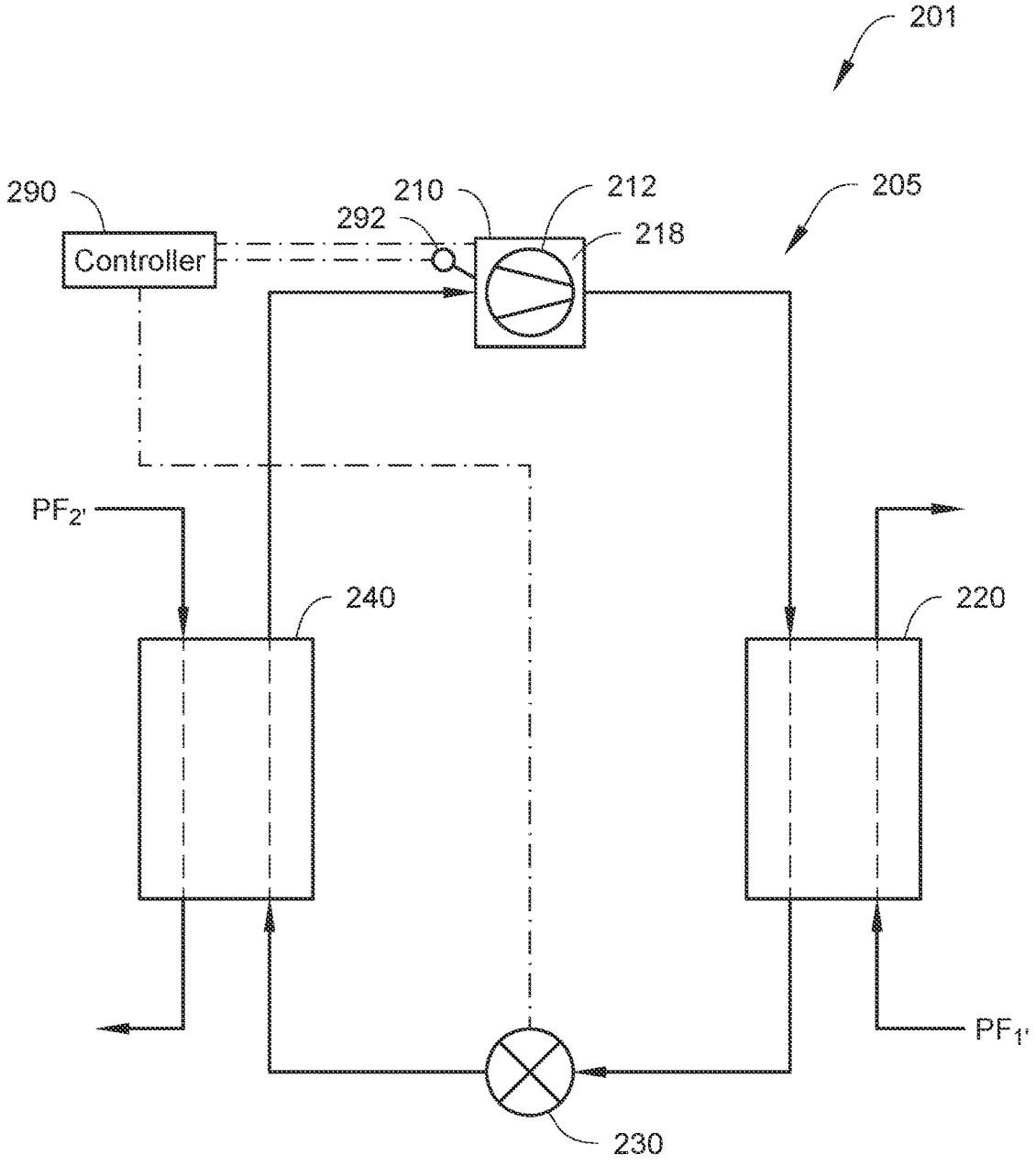
FIG. 3 is a schematic diagram of an embodiment of a refrigerant circuit of a HVACR system.

FIG. 3 is a schematic diagram of an embodiment of a refrigerant circuit 205 in a heating, ventilation, air conditioning, and refrigeration (HVACR) system 201. The HVACR system 201 in embodiments may be used/employed in similar manners as discussed above with respect to the HVACR system 1 in FIG. 1. The refrigerant circuit 205 can be configured as a cooling system that can be operated in a cooling mode, and/or the refrigerant circuit 205 can be configured to operate as a heat pump system that can run in a cooling mode and a heating mode.

As shown in FIG. 3, the refrigerant circuit 205 includes a compressor 210, a condenser 220, an expander 230, and an evaporator 240. In an embodiment, the refrigerant circuit 205 can be modified to include additional components as similarly discussed with respect to the refrigerant circuit 5 in FIG. 1. The refrigerant circuit 205 applies known principles of gas compression and heat transfer. The refrigerant circuit 205 can be configured to heat or cool a process fluid as similarly discussed above with respect to the refrigerant circuit 5 in FIG. 1.

During the operation of the refrigerant circuit 205, a working fluid (e.g., containing refrigerant, refrigerant mixture, or the like) flows into the compressor 210 from the evaporator 240 at a relatively lower pressure. The working fluid is oil-free (i.e., does not contain any oil). For example, the refrigerant(s) in the working fluid are used as the lubricant for mechanical components of the refrigerant circuit 205.

The compressor 210 compresses the gas into a high pressure state, which also heats the gas. The compressor 210 includes a compression mechanism 212 configured to move within the compressor 210 to compress the gas into the high pressure state. The compressor 210 may be, but is not limited to, a scroll compressor, a screw compressor, a centrifugal compressor, or the like. In an embodiment, the compressor 210 is a scroll compressor and the compression mechanism 212 is a pair of intermeshed scroll members. In an embodiment, the compressor 210 is screw compressor and the compression mechanism 212 is a pair of intermeshed screws. In an embodiment, the compressor 210 is a centrifugal compressor and the compression mechanism 212 is an impeller.

After being compressed, the relatively higher pressure and higher temperature gas flows from the compressor 210 to the condenser 220. The condenser 220 can have a configuration as similarly discussed for the condenser 20 in FIG. 1, such that the working fluid is cooled in the condenser 220 by a first process fluid $PF_{1'}$ (e.g., external air, external water, cooling/heater water, glycol, combinations thereof, or the like) that also separately flows through the condenser 220. The working fluid condenses to liquid and then flows from the condenser 220 into the expander 230. The expander 230 allows the working fluid to expand, which converts the working fluid to a mixed vapor and liquid state.

The relatively lower temperature, vapor/liquid working fluid then flows into the evaporator 240. A second process fluid $PF_2$ (e.g., air, chiller liquid, water, glycol, combinations thereof, or the like) also flows through the evaporator 240. The working fluid absorbs heat from the second process fluid $PF_2$ as it flows through the evaporator 240, which cools the second process fluid $PF_2$ as it flows through the evaporator 240. As the working fluid absorbs heat, the working fluid evaporates to vapor. The refrigerant circuit 205 and the evaporator 240 are configured such that the working fluid flowing from the evaporator 240 is in a mixed vapor and liquid state. The evaporator 240 is a type that allows for discharging working fluid that includes liquid working fluid. For example, the evaporator 240 in an embodiment may be a direct-expansion evaporator or a modified flooded evaporator (e.g., flooded evaporator with additional piping and/or a valve to also discharge liquid).

The vapor/liquid working fluid then flows from the evaporator 240 into the compressor 210. The vapor/liquid working fluid flows into a liquid-vapor separation volume 218 of the compressor 210. The liquid working fluid in the liquid-vapor separation volume 218 is used to lubricate and/or cool components of the compressor 210 (e.g., bearings, motor, or the like). The gaseous working fluid in the liquid-vapor separation volume 218 flows into and is compressed by the compression mechanism 212. The compressed working fluid is discharged from the compressor 210 and is supplied from the compressor 210 to the condenser 220 as discussed above. The main flow path of the refrigerant circuit 205 (of the working fluid) extends from the compression mechanism 218 of the compressor 210 through the condenser 220, the expander 230, the evaporator 240, and the liquid-vapor separation volume 218 and back to the compression mechanism 212. The above-described process continues while the refrigerant circuit 205 is operated, for example, in a cooling mode.

The HVACR system 1 can also include a controller 290. In an embodiment, the controller 90 may be the controller of the HVACR system 1. In an embodiment, the controller 290 may be the controller of the refrigerant circuit 205. For example, the controller 290 may be the controller of the compressor 210. The controller 290 can configured to detect a liquid level of the liquid working fluid in the liquid-vapor separation volume 218 of the compressor 210 using a level sensor 292, control the compressor 210, and/or control the expander 230 as similarly discussed with respect to the controller 90 in FIG. 1. The controller 90 can be configured to control the liquid level of the liquid working fluid in the liquid-vapor separation volume 218 of the compressor 210. For example, the controller 290 may adjust the expander 230 (e.g., adjust the valve position of the expander 230) to control the liquid level of the liquid working fluid in the liquid-vapor separation volume 218 of the compressor 210. In an embodiment, the controller 290 may be configured to control the liquid level to be above a (first) predetermined level (e.g., a predetermined minimum level) and/or below a (second) predetermined level (e.g., a predetermined maximum level). For example, the controller 290 can control the liquid level to be in a predetermined range (e.g., to be above the first predetermined level and below the second predetermined level). For example, the predetermined first level can be based on supplying a minimum flow of the liquid working fluid for lubrication. For example, the predetermined second level can be based on preventing flooding of the compressor 210 and/or preventing the liquid from flowing into the compression mechanism 212.

Figure 4:
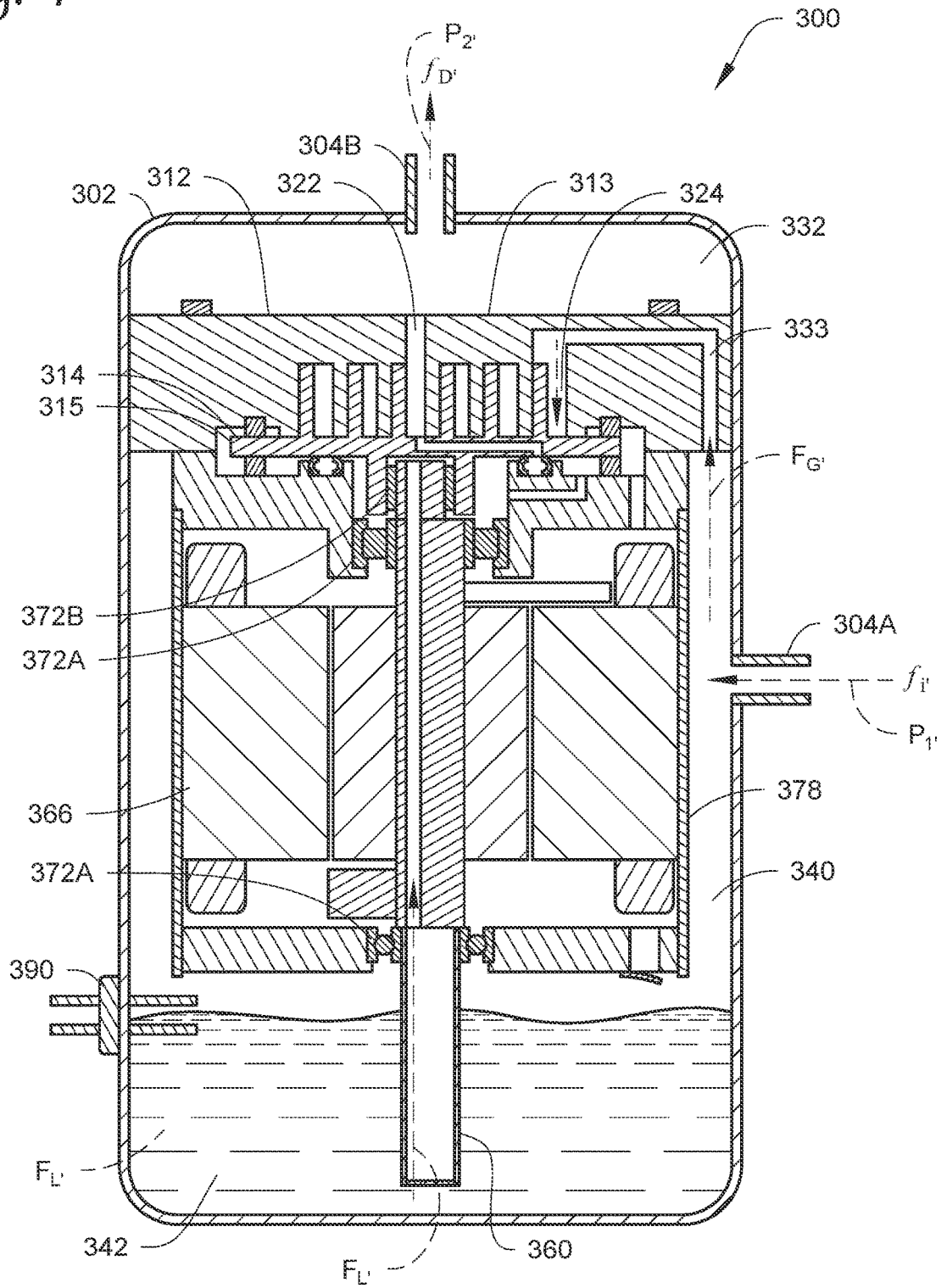
FIG. 4 is a schematic diagram of a cross section of an embodiment of a compressor.

FIG. 4 is a schematic cross-sectional view of a compressor 300. In an embodiment, the compressor 300 may be the compressor 210 in the refrigerant circuit 205 in FIG. 3. FIG. 4 is a vertical cross section of the compressor 300. The compressor 300 includes a compressor housing 302 that contains components of the compressor 300. The compressor housing 302 is shown as a single piece in FIG. 4. In an embodiment, the compressor housing 302 may be formed of a plurality of segments that are affixed together.

The compressor 300 in FIG. 4 is a scroll compressor and can generally have similar components as discussed with the compressor 100 in FIG. 2, except the compressor 300 does not utilize intermediate pressure working fluid and the liquid-vapor separation volume is applied to mixed phase working fluid that is the working fluid to be compressed. For example, the compressor 300 includes a pair of intermeshed scroll members 312, 314 (e.g., fixed scroll 312, non-fixed scroll 314), the compressor housing 302 having an upper volume 332 and lower volume 340 separated by the fixed scroll member 312, a motor 366 configured to rotate a crankshaft 360 engaged with the non-fixed scroll 312 to move/orbit the non-fixed scroll 312, bearings 372A, 372B along the crankshaft 360, and an inner enclosure 378 for the motor 366, as similarly discussed for the compressor 100 in FIG. 2. Unless described otherwise for the compressor 300, it should be appreciated in an embodiment the compressor 300 and/or one more of the above components of the compressor 300 may be modified and/or have features similar manner as discussed herein for the compressor 100. It would be appreciated that concepts described for the compressor 300 may be applied to other types of compressors (e.g., screw compressor centrifugal compressor, or the like) that utilizes a different type of compression mechanism.

The compressor 300 includes a plurality of fluid ports that extend through the compressor housing 302 for supplying fluid into and discharge fluid from the compressor 300. Working fluid enters and exits the compressor 300 by flowing through fluid ports in the compressor housing 302. As shown in FIG. 4, the ports in the compressor housing 302 include a suction inlet 304A and a discharge outlet 304B. The suction inlet 304A fluidly connects to the lower volume 340 of the compressor 300. Working fluid supplied to the suction inlet 304A is directed into the lower volume 340 of the compressor 300. The discharge outlet 304B fluidly connects to the discharge volume 322 of the intermeshed scrolls 312, 314. The working fluid compressed by the intermeshed scrolls 312, 314 is discharged out of the compressor 300 through the discharge outlet 304B. In the illustrated embodiment, the discharge volume 322 is fluidly connected to the upper volume 332 of the compressor 300 (e.g., via a discharge passageway in the baseplate 313 of the fixed scroll 312), and the discharge outlet 304B is fluidly connected to the upper volume 332. For example, the discharge volume 322 is configured to discharge compressed working fluid into the upper volume 332 (e.g., via the discharge passageway), and the upper volume 332 directs the compressed working fluid into and through the discharge outlet 304B.

An inlet flow $f_{l'}$ of the working fluid to be compressed flows into the compressor 300 though the suction inlet 304A in the compressor housing 302 at a relatively lower pressure (e.g., at a first pressure $P_{1'}$). For example, the inlet flow fr of the working fluid is supplied from the evaporator in the refrigerant circuit of the compressor 300 (e.g., evaporator 240 in FIG. 3). The working fluid in the inlet flow $f_{i'}$ is a mixed phase of working fluid that contains liquid working fluid $F_{L'}$ and gaseous working fluid $F_{G'}$. The suction inlet 304A directs the inlet flow $f_{i'}$ of the working fluid into the lower volume 340 of the compressor 300. The lower volume 340 of the compressor 300 is a liquid-vapor separation volume.

The liquid (inlet pressure) working fluid $F_{L'}$ accumulates within the lower volume 340. In particular, the liquid working fluid $F_{L'}$ accumulates in a bottom 342 of the lower volume 340. The liquid working fluid $F_{L'}$ can be supplied to mechanical component(s) of the compressor 300 to lubricate said mechanical component(s), as similarly described for the compressor 100 in FIG. 2. For example, the liquid working fluid $F_{L'}$ is supplied to one or more bearing(s) 372A, 372B along the crankshaft 360. The liquid working fluid $F_{L'}$ can also be supplied to an alignment coupler for the intermeshed scrolls 312, 314 (e.g., an Oldham coupling). In the illustrated embodiment, the liquid working fluid $F_{L'}$ is also supplied to the motor 366 to provide cooling (e.g., directed into the inner enclosure 378, directed onto the motor 366). In the illustrated embodiment, the liquid working fluid $F_{L'}$ is supplied to the bearing(s) 372A, 372B, alignment coupler, and the inner enclosure 378 in a similar manner to the compressor 100 in FIG. 2 (e.g., through an interior gallery of the crankshaft 360, via liquid supply passageway(s), and the like).

The gaseous (inlet pressure) working fluid $F_{G'}$ is directed into the inlet 324 of the intermeshed scrolls 312, 314. A suction passageway 333 fluidly connects the lower volume 340 to the inlet 324 of the intermeshed scrolls 312, 314. In the illustrated embodiment, the fixed scroll 312 includes the suction passageway 333. The suction passageway 333 extends from the lower volume 340 to the inlet 324 of the intermeshed scrolls 312, 314. The suction passageway 333 is configured to direct the gaseous working fluid $F_{G'}$ from the lower volume 340 to the inlet 324 of the intermeshed scrolls 312, 314.

The working fluid $F_{G'}$ is compressed by the intermeshed scrolls 312, 314 as the working fluid travels between the intermeshed scrolls 312, 314 (e.g., within the compression pockets). The compressed working fluid flows out of the scroll compressor 300 by flowing from the discharge volume 322 to the upper volume 332 and through the discharge outlet 304B. A discharge flow $f_{D'}$ of the working fluid is discharged from the discharge outlet 304A of the compressor 300 at a relatively higher pressure (e.g., at a second pressure $P_{2'}$ greater than the first pressure $P_{1'}$).

The compressor 300 includes a level sensor 390 configured to detect a level of the liquid working fluid $F_{L'}$ within the lower volume 340 of the compressor 300. For example, level sensor detects the level of the liquid working fluid $F_{L'}$ in the bottom 342 of the lower volume 340. A controller of the HVACR system of the compressor 300 (e.g., controller 390 in FIG. 3) may be configured to detect the level of the liquid working fluid $F_L$ within the lower volume 340 of the compressor 300 using the level sensor 390. In an embodiment, the controller may be configured to control the liquid level of the liquid working fluid $F_{L'}$ in the lower volume 340 of the compressor as discussed for the compressor 210 in FIG. 3.

Aspects: Any one of Aspects 1-9 may be combined with any one of Aspects 10-42, any of Aspects 10-20 may be combined with any one of Aspects 21-42, and any of Aspects 21-30 may be combined with any of Aspects 31-42.

Aspect 1. An oil-free scroll compressor, comprising: a compressor housing including a suction inlet and a discharge outlet; a pair of intermeshed scroll members disposed within the compressor housing, the pair of intermeshed scroll members having an inlet fluidly connected to the suction inlet and a discharge volume fluidly connected to the discharge outlet; a crankshaft engaged with a non-fixed scroll member in the pair of intermeshed scroll members; a bearing for supporting the crankshaft; and a liquid-vapor separation volume disposed within the compressor housing, the liquid-vapor separation volume configured to separate a mixed phase of working fluid into liquid working fluid and gaseous working fluid, wherein the liquid working fluid is supplied to the bearing.

Aspect 2. The oil-free compressor of Aspect 1, further comprising: an inner enclosure disposed in the compressor housing, and a motor is disposed in the inner enclosure and is configured to rotate the crankshaft, the crankshaft including an interior gallery, and rotation of the crankshaft is configured to supply a portion of the liquid working fluid through the interior gallery and one or more liquid passages into the inner enclosure.

Aspect 3. The oil-free compressor of Aspect 2, wherein the one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

Aspect 4. The oil-free compressor of any one of Aspects 1-3, wherein the compressor housing includes a separator inlet for the liquid-vapor separation volume and a separator outlet for the liquid-vapor separation volume, and the pair of intermeshed scroll members are intermeshed to form compression pockets within the compressor housing, an intermediate injection port fluidly connects the liquid-vapor separation volume to at least one of the compression pockets.

Aspect 5. The oil-free scroll compressor of Aspect 4, wherein the liquid-vapor separation volume is configured to receive, via the separator inlet, the mixed phase of the working fluid, and to discharge the liquid working fluid from the oil-free compressor through the separator outlet.

Aspect 6. The oil-free scroll compressor of any one of Aspects 4 and 5, wherein the intermediate injection port is configured to direct the gaseous working fluid into the at least one of the compression pockets.

Aspect 7. The oil-free scroll compressor of any one of Aspects 4-6, wherein the pair of intermeshed scroll members is configured to compress the working fluid from an inlet pressure to a discharge pressure, and the liquid-vapor separation volume is configured to receive the working fluid at an intermediate pressure that is between the inlet pressure and the discharge pressure.

Aspect 8. The oil-free scroll compressor of any one of Aspects 1-3, wherein the suction inlet is fluidly connected to the liquid-vapor separation volume, a suction passageway fluidly connecting the liquid-vapor separation volume to the inlet of the pair of scroll members.

Aspect 9. The oil-free scroll compressor of Aspect 8, wherein the liquid-vapor separation volume is configured to receive, via the suction inlet, the mixed phase of the working fluid and to separate the gaseous working fluid from the liquid working fluid within the liquid-vapor separation, and the suction passageway is configured to direct the gaseous working fluid to the inlet of the pair of intermeshed scroll members.

Aspect 10. A heating, ventilation, air conditioning, and refrigeration (HVACR) system comprising: a refrigerant circuit including: an oil-free scroll compressor configured to compress a working fluid, the oil-free scroll compressor including: a compressor housing including a suction inlet and a discharge outlet, a pair of intermeshed scroll members disposed within the compressor housing, the pair of intermeshed scroll members having an inlet fluidly connected to the suction inlet and a discharge volume fluidly connected to the discharge outlet, a crankshaft engaged with a non-fixed scroll member in the pair of intermeshed scroll members, a bearing for supporting the crankshaft, and a liquid-vapor separation volume disposed within the compressor housing, the liquid-vapor separation volume configured to separate a mixed phase of the working fluid into liquid working fluid and a gaseous working fluid, wherein the liquid working fluid is supplied to the bearing; a condenser configured to cool the working fluid compressed by the oil-free scroll compressor; one or more expanders configured to expand the working fluid cooled by the condenser; and an evaporator configured to cool a second process fluid using the working fluid expanded by the one or more expanders.

Aspect 11. The HVACR system of Aspect 10, wherein the oil-free compressor includes: an inner enclosure disposed in the compressor housing, and a motor is disposed in the inner enclosure and is configured to rotate the crankshaft, the crankshaft including an interior gallery, and rotation of the crankshaft is configured to supply a portion of the liquid working fluid through the interior gallery and one or more liquid passages into the inner enclosure.

Aspect 12. The HVACR system of Aspect 11, wherein the one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

Aspect 13. The HVACR system of any one of Aspects 10-12, wherein the compressor housing of the oil-free compressor includes a separator inlet for the liquid-vapor separation volume and a separator outlet for the liquid-vapor separation volume, the one or more expanders include a first expander fluidly connecting the condenser to the separator inlet of the oil-free compressor and a second expander fluidly connecting the separator outlet of the oil-free compressor to the evaporator, and the pair of intermeshed scroll members are intermeshed to form compression pockets within the compressor housing, an intermediate injection port fluidly connecting the liquid-vapor separation volume to at least one of the compression pockets.

Aspect 14. The HVACR system of Aspect 13, wherein the separator inlet is configured to receive the mixed phase of the working fluid from the first expander, and the second expander is configured to receive the liquid working fluid from the outlet of the separator outlet.

Aspect 15. The HVACR system of any one of Aspects 13 and 14, wherein the intermediate injection port is configured to direct the gaseous working fluid into the at least one of the compression pockets.

Aspect 16. The HVACR system of Aspect 10, wherein the suction inlet is fluidly connected to the liquid-vapor separation volume, a suction passageway fluidly connecting the liquid-vapor separation volume to the inlet of the pair of intermeshed scroll members.

Aspect 17. The HVACR system of Aspect 16, wherein the liquid-vapor separation volume is configured to receive, via the suction inlet, the mixed phase of the working fluid and to separate the gaseous working fluid from the liquid working fluid within the liquid-vapor separation, and the suction passageway is configured to direct the gaseous working fluid to the inlet of the pair of intermeshed scroll members.

Aspect 18. The HVACR system of any one of Aspects 10-17, further comprising: a level sensor for the liquid-vapor separation volume; and a controller configured to: detect, using the level sensor, a liquid level of the liquid working fluid in the liquid-vapor separation volume, and control the one or more expanders based on the liquid working fluid in the liquid-vapor separation volume.

Aspect 19. The HVACR system of Aspect 18, wherein the one or more expanders includes a first expander, and the controller is configured to adjust the first expander based on the liquid level in the liquid-vapor separation volume.

Aspect 20. The HVACR system of Aspect 19, wherein the controller is configured to adjust a valve position of the first expander based on the liquid working level in the liquid-vapor separation volume to be above or below a predetermined level.

Aspect 21. An oil-free compressor, comprising: a compressor housing including a suction inlet and a discharge outlet; a compression mechanism disposed within the compressor housing, the compression mechanism having an inlet fluidly connected to the suction inlet and a discharge volume fluidly connected to the discharge outlet; a crankshaft engaged the compression mechanism, rotation of the crankshaft configured to drive the compression mechanism to provide compression; a bearing for supporting the crankshaft; and a liquid-vapor separation volume disposed within the compressor housing, the liquid-vapor separation volume configured to separate a mixed phase of working fluid into liquid working fluid and gaseous working fluid, wherein the liquid working fluid is supplied to the bearing.

Aspect 22. The oil-free compressor of Aspect 21, further comprising: an inner enclosure disposed in the compressor housing, and a motor is disposed in the inner enclosure and is configured to rotate the crankshaft, the crankshaft including an interior gallery, and the rotation of the crankshaft is configured to supply a portion of the liquid working fluid through the interior gallery and one or more liquid passages into the inner enclosure.

Aspect 23. The oil-free compressor of Aspect 222, wherein the oil-free compressor is a scroll compressor, the compression mechanism being a pair of intermeshed scroll members, the crankshaft engaged with a non-fixed scroll member in the pair of intermeshed scroll members, and the one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

Aspect 24. The oil-free compressor of any one of Aspects 21-23, wherein the compressor housing includes a separator inlet for the liquid-vapor separation volume and a separator outlet for the liquid-vapor separation volume, and the compression mechanism forms compression pockets within the compressor housing, an intermediate injection port fluidly connects the liquid-vapor separation volume to at least one of the compression pockets.

Aspect 25. The oil-free compressor of Aspect 24, wherein the liquid-vapor separation volume is configured to receive, via the separator inlet, the mixed phase of the working fluid, and to discharge the liquid working fluid from the oil-free compressor through the separator outlet.

Aspect 26. The oil-free compressor of any one of Aspects 24 and 25, wherein the intermediate injection port is configured to direct the gaseous working fluid into the at least one of the compression pockets.

Aspect 27. The oil-free compressor of any one of Aspects 24-26, wherein compression mechanism is configured to compress the working fluid from an inlet pressure to a discharge pressure, and the liquid-vapor separation volume is configured to receive the working fluid at an intermediate pressure that is between the inlet pressure and the discharge pressure.

Aspect 28. The oil-free compressor of any one of Aspects 21-23, wherein the suction inlet is fluidly connected to the liquid-vapor separation volume, a suction passageway fluidly connecting the liquid-vapor separation volume to the inlet of compression mechanism.

Aspect 29. The oil-free compressor of Aspect 28, wherein the liquid-vapor separation volume is configured to receive, via the suction inlet, the mixed phase of the working fluid and to separate the gaseous working fluid from the liquid working fluid within the liquid-vapor separation, and the suction passageway is configured to direct the gaseous working fluid to the inlet of the compression mechanism.

Aspect 30. The oil-free compressor of any one of Aspects 21-29, wherein the oil-free compressor is a scroll compressor, the compression mechanism being a pair of intermeshed scroll members, the crankshaft engaged with a non-fixed scroll member in the pair of intermeshed scroll members, Aspect 31. A heating, ventilation, air conditioning, and refrigeration (HVACR) system comprising: a refrigerant circuit including: an oil-free compressor configured to compress a working fluid, the oil-free compressor including: a compressor housing including a suction inlet and a discharge outlet, a compression mechanism disposed within the compressor housing, the compression mechanism having an inlet fluidly connected to the suction inlet and a discharge volume fluidly connected to the discharge outlet, a crankshaft engaged with the compression mechanism, rotation of the crankshaft configured to drive the compression mechanism to compress the working fluid, a bearing for supporting the crankshaft, and a liquid-vapor separation volume disposed within the compressor housing, the liquid-vapor separation volume configured to separate a mixed phase of the working fluid into liquid working fluid and a gaseous working fluid, wherein the liquid working fluid is supplied to the bearing; a condenser configured to cool the working fluid compressed by the oil-free compressor; one or more expanders configured to expand the working fluid cooled by the condenser; and an evaporator configured to cool a second process fluid using the working fluid expanded by the one or more expanders.

Aspect 32. The HVACR system of Aspect 31, wherein the oil-free compressor includes: an inner enclosure disposed in the compressor housing, and a motor is disposed in the inner enclosure and is configured to rotate the crankshaft, the crankshaft including an interior gallery, and the rotation of the crankshaft is configured to supply a portion of the liquid working fluid through the interior gallery and one or more liquid passages into the inner enclosure.

Aspect 33. The HVACR system of Aspect 32, wherein the oil-free compressor is a scroll compressor, the compression mechanism being a pair of intermeshed scroll members, the crankshaft engaged with a non-fixed scroll member in the pair of intermeshed scroll members, and the one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

Aspect 34. The HVACR system of any one of Aspects 31-33, wherein the compressor housing of the oil-free compressor includes a separator inlet for the liquid-vapor separation volume and a separator outlet for the liquid-vapor separation volume, the one or more expanders include a first expander fluidly connecting the condenser to the separator inlet of the oil-free compressor and a second expander fluidly connecting the separator outlet of the oil-free compressor to the evaporator, and the compression mechanism forms compression pockets within the compressor housing, an intermediate injection port fluidly connecting the liquid-vapor separation volume to at least one of the compression pockets.

Aspect 35. The HVACR system of Aspect 34, wherein the separator inlet is configured to receive the mixed phase of the working fluid from the first expander, and the second expander is configured to receive the liquid working fluid from the outlet of the separator outlet.

Aspect 36. The HVACR system of any one of Aspects 34 and 35, wherein the intermediate injection port is configured to direct the gaseous working fluid into the at least one of the compression pockets.

Aspect 37. The HVACR system of any one of Aspects 31-33, wherein the suction inlet is fluidly connected to the liquid-vapor separation volume, a suction passageway fluidly connecting the liquid-vapor separation volume to the inlet of the compression mechanism.

Aspect 38. The HVACR system of Aspect 37, wherein the liquid-vapor separation volume is configured to receive, via the suction inlet, the mixed phase of the working fluid and to separate the gaseous working fluid from the liquid working fluid within the liquid-vapor separation, and the suction passageway is configured to direct the gaseous working fluid to the inlet of the compression mechanism.

Aspect 39. The HVACR system of any one of Aspects 31-38, further comprising: a level sensor for the liquid-vapor separation volume; and a controller configured to: detect, using the level sensor, a liquid level of the liquid working fluid in the liquid-vapor separation volume, and control the one or more expanders based on the liquid working fluid in the liquid-vapor separation volume.

Aspect 40. The HVACR system of Aspect 39, wherein the one or more expanders includes a first expander, and the controller is configured to adjust the first expander based on the liquid level in the liquid-vapor separation volume.

Aspect 41. The HVACR system of Aspect 40, wherein the controller is configured to adjust a valve position of the first expander based on the liquid working level in the liquid-vapor separation volume to be above or below a predetermined level.

Aspect 42. The HVACR system of any one of Aspects 31-41, wherein the oil-free compressor is a scroll compressor, the compression mechanism being a pair of intermeshed scroll members, the crankshaft engaged with a non-fixed scroll member in the pair of intermeshed scroll members.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting", and "connects" as described herein can refer to being "directly connected", "directly connecting", and "directly connects".

With regard to the preceding description, it is to be understood that changes may be made in detail, especially in matters of the construction materials employed and the shape, size, and arrangement of parts without departing from the scope of the present disclosure. It should be appreciated that a range for a component in a composition may be formed by combining an upper limit, a lower limit, and/or an amount described herein for said component. This Specification and the embodiments described are exemplary only, with the true scope and spirit of the disclosure being indicated by the claims that follow.

What is claimed is:

1. An oil-free compressor, comprising:

a compressor housing including a suction inlet and a discharge outlet;

a compression mechanism disposed within the compressor housing, the compression mechanism having an inlet fluidly connected to the suction inlet and a discharge volume fluidly connected to the discharge outlet;

a crankshaft engaged with the compression mechanism, rotation of the crankshaft configured to drive the compression mechanism to provide compression;

a bearing for supporting the crankshaft; and a liquid-vapor separation volume disposed within the compressor housing, the liquid-vapor separation volume configured to separate a mixed phase of working fluid into liquid working fluid and gaseous working fluid, the mixed phase of the working fluid being received by the liquid-vapor separation volume at a pressure less than a discharge pressure of the compressor, wherein the liquid working fluid is supplied to the bearing.

2. The oil-free compressor of claim 1, further comprising:

an inner enclosure disposed in the compressor housing, and a motor is disposed in the inner enclosure and is configured to rotate the crankshaft, the crankshaft including an interior gallery, and the rotation of the crankshaft is configured to supply a portion of the liquid working fluid through the interior gallery and one or more liquid passages into the inner enclosure.

3. The oil-free compressor of claim 2, wherein the oil-free compressor is a scroll compressor, the compression mechanism being a pair of intermeshed scroll members, the crankshaft engaged with a non-fixed scroll member in the pair of intermeshed scroll members, and the one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

4. The oil-free compressor of claim 1, wherein the compressor housing includes a separator inlet for the liquid-vapor separation volume and a separator outlet for the liquid-vapor separation volume, and the compression mechanism forms compression pockets within the compressor housing, an intermediate injection port fluidly connects the liquid-vapor separation volume to at least one of the compression pockets.

5. The oil-free compressor of claim 4, wherein the liquid-vapor separation volume is configured to receive, via the separator inlet, the mixed phase of the working fluid, and to discharge the liquid working fluid from the oil-free compressor through the separator outlet.

6. The oil-free compressor of claim 4, wherein the intermediate injection port is configured to direct the gaseous working fluid into the at least one of the compression pockets.

7. The oil-free compressor of claim 4, wherein the compression mechanism is configured to compress the working fluid from an inlet pressure to the discharge pressure, the pressure of the mixed phase of the working fluid is an intermediate pressure, and the liquid-vapor separation volume is configured to receive the mixed phase of the working fluid at the intermediate pressure that is between the inlet pressure and the discharge pressure.

8. The oil-free compressor of claim 1, wherein the suction inlet is fluidly connected to the liquid-vapor separation volume, a suction passageway fluidly connecting the liquid-vapor separation volume to the inlet of the compression mechanism.

9. The oil-free compressor of claim 8, wherein the liquid-vapor separation volume is configured to receive, via the suction inlet, the mixed phase of the working fluid and to separate the gaseous working fluid from the liquid working fluid within the liquid-vapor separation volume, the pressure of the mixed phase of the working fluid being a suction pressure of the compressor, and the suction passageway is configured to direct the gaseous working fluid to the inlet of the compression mechanism.

10. A heating, ventilation, air conditioning, and refrigeration (HVACR) system comprising:

a refrigerant circuit including:

an oil-free compressor configured to compress a working fluid, the oil-free compressor including:

a compressor housing including a suction inlet and a discharge outlet, a compression mechanism disposed within the compressor housing, the compression mechanism having an inlet fluidly connected to the suction inlet and a discharge volume fluidly connected to the discharge outlet, a crankshaft engaged with the compression mechanism, rotation of the crankshaft configured to drive the compression mechanism to compress the working fluid, a bearing for supporting the crankshaft, and a liquid-vapor separation volume disposed within the compressor housing, the liquid-vapor separation volume configured to separate a mixed phase of the working fluid into liquid working fluid and a gaseous working fluid, the mixed phase of the working fluid being received by the liquid-vapor separation volume at a pressure less than a discharge pressure of the compressor, wherein the liquid working fluid is supplied to the bearing;

a condenser configured to cool the working fluid compressed by the oil-free compressor;

one or more expanders configured to expand the working fluid cooled by the condenser; and an evaporator configured to cool a second process fluid using the working fluid expanded by the one or more expanders.

11. The HVACR system of claim 10, wherein the oil-free compressor includes:

an inner enclosure disposed in the compressor housing, and a motor is disposed in the inner enclosure and is configured to rotate the crankshaft, the crankshaft including an interior gallery, and the rotation of the crankshaft is configured to supply a portion of the liquid working fluid through the interior gallery and one or more liquid passages into the inner enclosure.

12. The HVACR system of claim 11, wherein the oil-free compressor is a scroll compressor, the compression mechanism being a pair of intermeshed scroll members, the crankshaft engaged with a non-fixed scroll member in the pair of intermeshed scroll members, and the one or more liquid passages include a first liquid passage that fluidly connects the interior gallery of the crankshaft to an alignment coupler for the pair of intermeshed scroll members and a second liquid passage that fluidly connects the alignment coupler to the inner enclosure.

13. The HVACR system of claim 10, wherein the compressor housing of the oil-free compressor includes a separator inlet for the liquid-vapor separation volume and a separator outlet for the liquid-vapor separation volume, the one or more expanders include a first expander fluidly connecting the condenser to the separator inlet of the oil-free compressor and a second expander fluidly connecting the separator outlet of the oil-free compressor to the evaporator, and the compression mechanism forms compression pockets within the compressor housing, an intermediate injection port fluidly connecting the liquid-vapor separation volume to at least one of the compression pockets.

14. The HVACR system of claim 13, wherein the separator inlet is configured to receive the mixed phase of the working fluid from the first expander, and the second expander is configured to receive the liquid working fluid from the separator outlet.

15. The HVACR system of claim 13, wherein the intermediate injection port is configured to direct the gaseous working fluid into the at least one of the compression pockets.

16. The HVACR system of claim 10, wherein the suction inlet is fluidly connected to the liquid-vapor separation volume, a suction passageway fluidly connecting the liquid-vapor separation volume to the inlet of the compression mechanism.

17. The HVACR system of claim 16, wherein the liquid-vapor separation volume is configured to receive, via the suction inlet, the mixed phase of the working fluid and to separate the gaseous working fluid from the liquid working fluid within the liquid-vapor separation volume, the pressure of the mixed phase of the working fluid being a suction pressure of the compressor, and the suction passageway is configured to direct the gaseous working fluid to the inlet of the compression mechanism.

18. The HVACR system of claim 10, further comprising:

a level sensor for the liquid-vapor separation volume; and a controller configured to:

detect, using the level sensor, a liquid level of the liquid working fluid in the liquid-vapor separation volume, and control the one or more expanders based on the liquid working fluid in the liquid-vapor separation volume.

19. The HVACR system of claim 18, wherein the one or more expanders includes a first expander, the controller is configured to adjust a valve position of the first expander based on the liquid level of the liquid working fluid in the liquid-vapor separation volume to be above or below a predetermined level.

20. The HVACR system of claim 13, wherein the compression mechanism is configured to compress the working fluid from an inlet pressure to the discharge pressure, the pressure of the mixed phase of the working fluid is an intermediate pressure, and the liquid-vapor separation volume is configured to receive the mixed phase of the working fluid at the intermediate pressure that is between the inlet pressure and the discharge pressure.

* * * * *